United States Patent [19]

Zivny

[11] 4,416,611

[45] Nov. 22, 1983

[54] FLUE DAMPER CONTROL

[76] Inventor: Joseph C. Zivny, 208 Northwood Rd., Riverside, Ill. 60546

[21] Appl. No.: 215,108

[22] Filed: Dec. 10, 1980

[51] Int. Cl.[3] ..... F23N 3/00

[52] U.S. Cl. ..... 431/20; 236/1 G

[58] Field of Search ..... 431/20; 126/285 R, 285 B; 236/1 G, 45; 110/163; 126/288

[56] References Cited

U.S. PATENT DOCUMENTS

| | | | |
|---|---|---|---|
| 2,085,912 | 7/1937 | Lencke et al. | 431/20 |
| 2,117,787 | 5/1938 | Bock | 236/1 G |
| 2,698,140 | 12/1954 | Buehler | 431/20 |
| 2,856,992 | 10/1958 | Bartels | 431/20 |

*Primary Examiner*—Lee E. Barrett

*Attorney, Agent, or Firm*—Merriam, Marshall & Bicknell

[57] ABSTRACT

This disclosure relates to a flue damper control including an automatic control and a manual override for use in the event of failure of certain parts. The control includes a first lever means connected to the damper for opening and closing the damper. An electric solenoid is connected in circuit with a furnace thermostat, and the solenoid is coupled by spring means to the first lever means. In automatic operation, when the thermostat calls for heat, the solenoid armature moves, and the first lever means is operated by the spring means coupling to move the damper to the open position. A return spring moves the damper to the closed position when the thermostat no longer calls for heat. The control further includes a first switch connected in circuit with a fuel control valve, which is actuated by the first switch means as it opens the damper. The control further includes a manual override lever that is movable from a normal position to an override position and connected to move the first lever means to open the damper when moved to the override position. A second switch is connected in parallel with the first switch and is actuated by the override lever upon movement to said override position.

11 Claims, 9 Drawing Figures

10
11
12
13
14
16
17
24
28
31
32
33
41
42
44
46
47
51
52
54
56
57
61
62
63
66
91
94
96
3

FLUE DAMPER CONTROL

DETAILED DESCRIPTION

The customary heating furnace of the type used to heat a home or a commercial building includes a fire or combustion chamber that receives fuel and a flue pipe that connects the furnace with a chimney. There is normally a draft which pulls air through the furnace and up the chimney in order to supply fresh air to complete the combustion process and also to remove the products of combustion from the interior of the home or building. This type of furnace is normally operated intermittently, and a thermostat is provided to control operation of the furnace. The thermostat is connected to an electric fuel control circuit which is constructed such that the fuel is burned only when the thermostat calls for heat. While the furnace is turned on and off in order to maintain a temperature set in the thermostat, the draft through the furnace and the chimney continues whether the furnace is operating or is not operating. When the furnace is not operating, this draft normally represents a heat loss from the furnace area since the heated air from the area is moved through the furnace and out of the chimney.

Automatic flue dampers or controls have long been known, and they have recently become popular as a means to conserve energy. Such an automatic flue damper includes a damper plate mounted in the flue pipe between the furnace and the chimney, the plate normally closing the pipe in order to stop the draft when the furnace is not operating. Usually an electrical mechanism is connected to the damper plate to pivot or turn the plate in order to open the flue pipe when the furnace is operating. In the customary operation, the plate is turned in order to open the flue pipe just before the fuel is ignited and the plate is turned to close off the pipe shortly after the furnace is turned off.

Numerous patents have issued covering such arrangements and the following listed U.S. patents are known to the inventor: U.S. Pat. Nos. 472,461, 1,413,122, 1,773,585, 2,085,912, 3,010,451, 3,934,796, 4,039,123, 4,138,060, 4,143,811, 4,155,699, 4,157,785, 4,205,783, 4,213,477.

While automatic flue dampers, as described above, have come into fairly wide use, their operation has not been entirely satisfactory. Prior art automatic flue dampers normally include an electric motor and reduction gear train which rotates in order to turn the plate. Such a motor drive requires frequency lubrication, and since they are mounted in a hot location, the lubrication dries and causes sticky bearings. Some flue dampers have included a solenoid instead of a motor, and while a solenoid is more reliable and has a long life, care must be taken in mounting them before these advantages may be realized. A solenoid used in such a mechanism also has a potential disadvantage. A solenoid operates with a rapid snap action, and if the solenoid armature is mechanically connected directly to the damper plate, as is true of prior art constructions, the snap action produces shocks and damage to the mechanism. This snap action operation also creates an excessive amount of noise which is carried throughout a residence by the heat ducts connected to the furnace.

Further, the prior art arrangements are such that the furnace cannot turn on unless the damper plate is open. While this is a necessary safety feature, it also has the disadvantage that if a part in the control circuit fails, preventing the damper plate from opening, the furnace cannot be turned on even though the remainder of the furnace is in satisfactory operating condition. While U.S. Pat. No. 3,934,796 discloses a damper permitting a person to operate the furnace by locking the damper in an open position and actuating a limit switch, such an arrangement is not satisfactory in the instance where the switch has failed.

It is a general object of the present invention to provide a new and improved automatic flue damper control which is operated by a solenoid and yet produces very little noise, has an effective manual override arrangement which is operable even though the normal operating parts fail, and includes an improved non-binding spring-linkage arrangement for turning the damper plate.

It is a more specific object of the invention to provide a flue damper control comprising a solenoid, movable first lever means connected to the armature of the solenoid, movable second lever means connected to the damper plate, and resilient means coupling the first and second lever means. A first switch is connected to a fuel control valve of the furnace, and the first switch is actuated by the second lever means after the damper plate is open. The flue damper further includes a manual override lever engageable with the second lever means for manually opening the damper plate. A second switch is connected in parallel with the first switch, and the manual override lever actuates the second switch when it is moved to an override position.

The foregoing and other objects and advantages of the present invention will be better understood from the following detailed description taken in conjunction with the accompanying figures of the drawings, wherein.

Figures 1, 5:
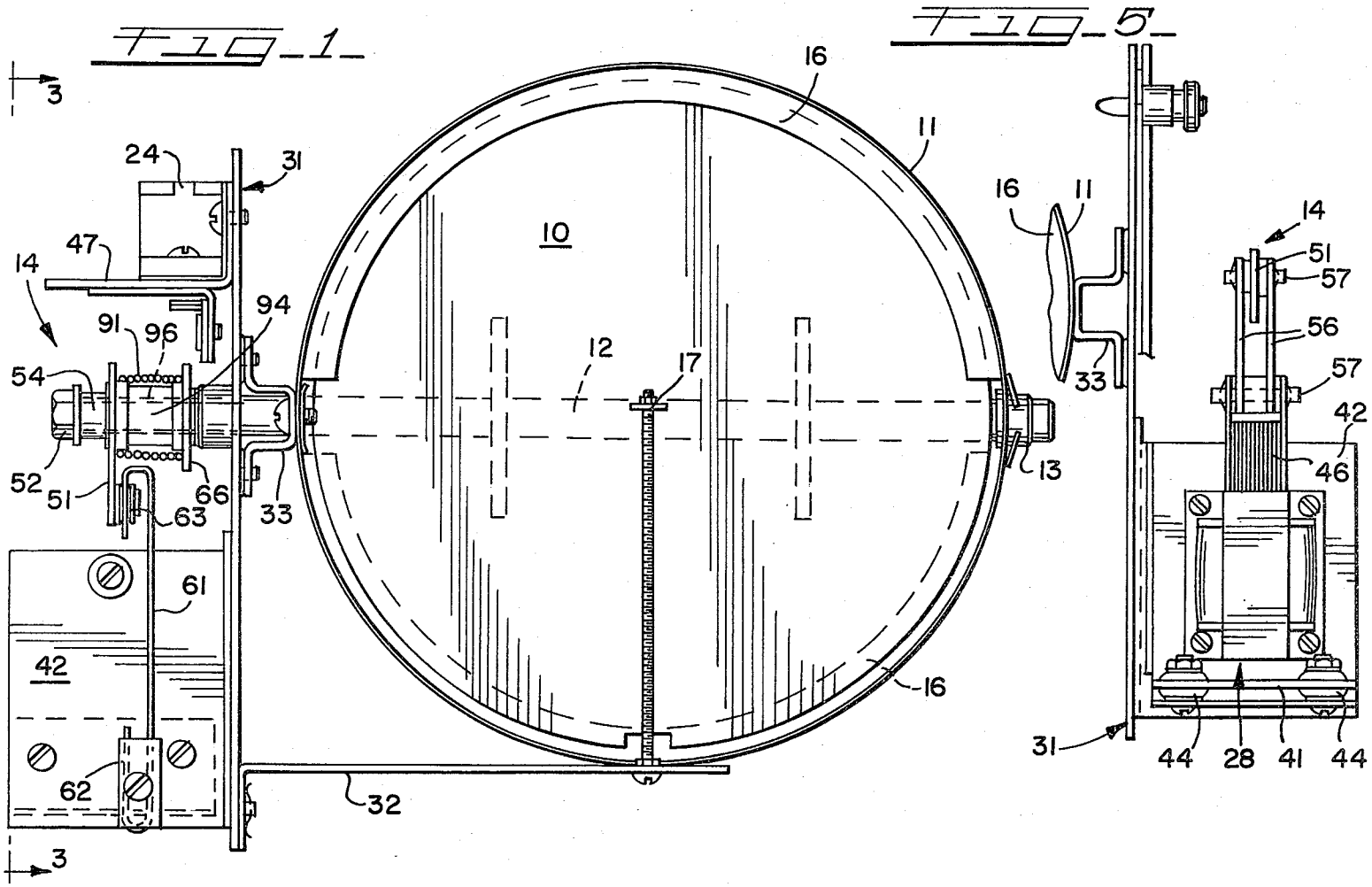
FIG. 1 is a view of a flue damper plate and automatic control mechanism embodying the present invention.
FIG. 5 is a fragmentary view taken on the line 5—5 of FIG. 3.

With reference first to FIG. 1, a damper plate 10 having a circular configuration in the present illustration, is positioned inside of a flue pipe 11. The damper plate 10 is secured to a plate pivot shaft 12 which is pivotally mounted on the flue pipe by a bearing 13 at one end of the shaft and by a mechanism 14 to be described in detail hereafter, at its other end. The plate 10 has a closed position shown in FIG. 1 where the outer edge of the plate engages a circular closed stop 16 that it is secured to the inner surface of the flue pipe 11 adjacent the plate 10. The other position of the plate 10 is the open position where the plate is parallel to the axis of the pipe 11 and engages an open stop 17 at approximately the center of the pipe. It will be obvious that when the plate 10 is in the open position and engages the stop 17, the pipe 11 is substantially open and when the plate 10 is pivoted to the closed position and engages the stop 16, the pipe 11 is substantially closed.

Figure 2:
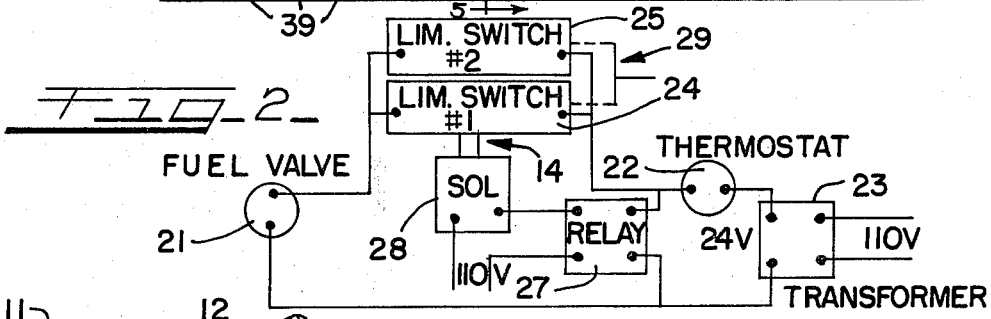
FIG. 2 is a schematic electrical diagram of part of the automatic control.

FIG. 2 illustrates the electrical control circuit. The reference numerals 21 and 22 indicates the customary fuel control valve of a furnace and the home thermostat, which are connected to a transformer 23. The transformer 23 provides, for example, a 24 volt control power supply for operating the thermostat 22 and the fuel valve 21. A pair of limit switches 24 and 25 are connected in parallel and the parallel connection is connected in series with the secondary of the transformer 23, the thermostat 22 and the gas valve 21, and it will be apparent that when the thermostat 22 is closed and one or both of the switches 24 and 25 are closed, the gas valve 21 will be energized. Energization of the valve 21 enables the fuel to flow into the furnace combustion chamber. The control circuit further includes a relay 27 that is connected in series with the thermostat 22 so that the relay 27 is operated only when the thermostat 22 is closed. The contacts of the relay 27 are connected to control a 110 volt power supply to a solenoid 28. The control mechanism 14, to be described in detail hereinafter, is indicated generally in FIG. 2 and connects the solenoid 28 with the limit switches 24 and 25. The reference numeral 29 in FIG. 2 indicates a manual override arrangement connected to the two limit switches 24 and 25 for closing the limit switches in the event of failure of one of the other parts.

Considering the operation of the circuit shown in FIG. 2, assume that a 110 volt supply is connected to the control circuit. When the thermostat 22 is open, the valve 21 is closed and fuel does not flow into the combustion chamber. In the event the thermostat closes, thus calling for heat, 24 volt power is connected to the relay 27. When the solenoid 28 is not energized, the mechanism 14 is in a position where the limit switches are not closed. When the relay 27 is energized by closing of the thermostat 22, the solenoid 28 is energized and movement of the armature of the solenoid causes the limit switch 24 to close. This completes the electrical path through the thermostat 22, the switch 24 and the valve 21 and fuel flows into the furnace combustion chamber. As will be described, the mechanism 14 is connected to the plate pivot shaft 12 in order to pivot the damper plate 10 to the open position when the solenoid 28 is energized. Subsequently, when the thermostat 22 opens, the relay 27 is deenergized causing the solenoid 28 to be deenergized and the limit switch 24 to open. As soon as the thermostat 22 and the switch 24 open, the valve 21 is deenergized and closes, thereby blocking the flow of fuel to the furnace combustion chamber.

In the event of failure of either the relay 27, the solenoid 28 or the limit switch 24, the apparatus may be manually operated using the manual override mechanism 29. As will be described, the override mechanism is connected to pivot the shaft 12 to move the plate 10 to the open position and also to close both of the switches 24 and 25. Consequently, assuming that the thermostat 22 is closed, the electrical circuit is completed through the two switches 24 and 25 and to the valve 21. The switches are, however, closed only when the override mechanism has pivoted the plate 10 to the open position. Of course, if both limit switches fail, the fuel valve cannot be activated.

Figure 3:
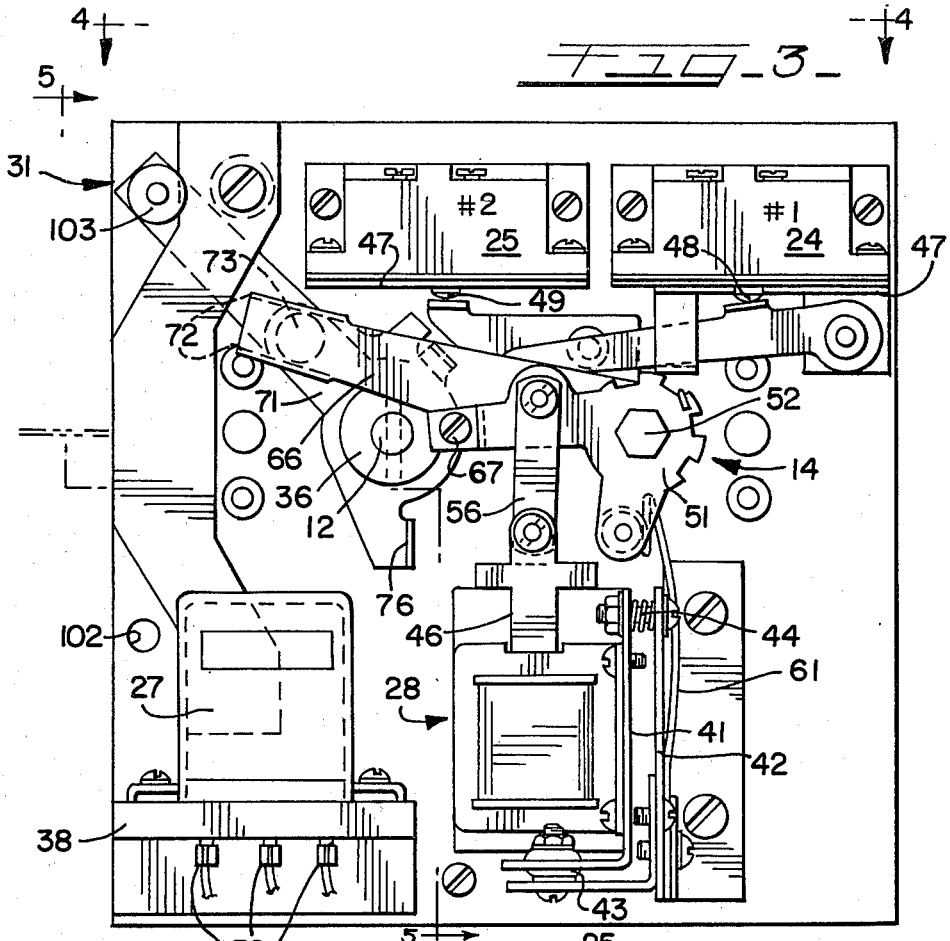
FIG. 3 is a view taken on the line 3—3 of FIG. 1.
Figure 4:
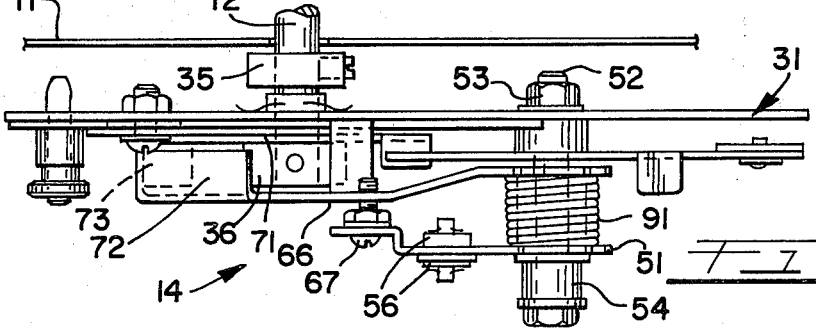
FIG. 4 is a fragmentary view taken on the line 4—4 of FIG. 3.

With specific reference to FIGS. 1, 3, 4, and 5, the control mechanism 14 is fastened to a generally rectangular mounting plate 31, which is secured to the flue pipe 11. In the present instance, the plate 31 is secured to the pipe by a right angle brace 32 that is screwed to the plate 31 and to the pipe 11, and by two mounting brackets 33 that are also screwed to the plate and to the pipe. The pivot shaft 12 extends through holes formed at diametrically opposite sides in the pipe 11 and through a hole formed in the plate 31. As shown in FIG. 4, an annular collar 35 is secured to the shaft 12 between the pipe 11 and the plate 31 by a set screw, and on the other side of the plate 31 another annular collar or hub 36 (FIG. 3) is secured to the outer end of the shaft 12, thereby holding the shaft 12 in axial position.

With reference to FIG. 3, the relay 27 is fastened by screws to a mounting bracket 38 which, in turn, is secured to the lower edge (as seen in FIG. 3) of the mounting plate 31. Electrical connectors 39 are located at the lower side of the relay in order to connect the relay with the other electrical components of the control system.

Figure 7:
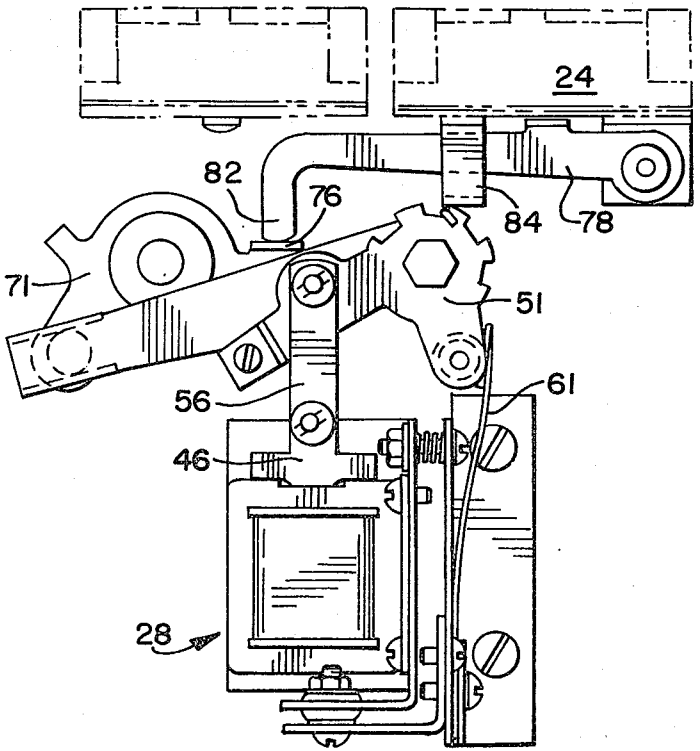
FIGS. 6 and 7 are fragmentary views illustrating the normal operation of the control mechanism.
Figure 6:
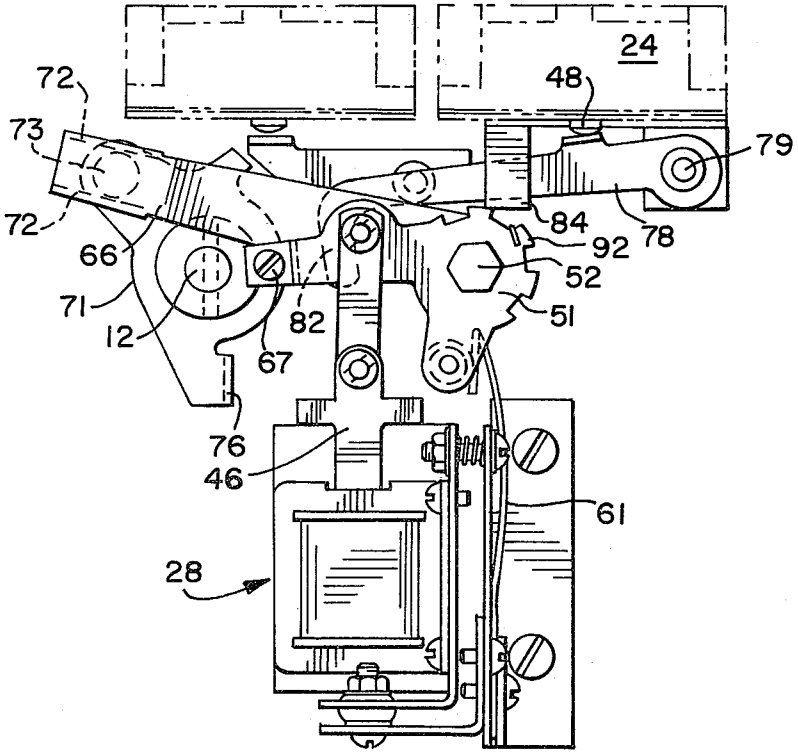

With particular reference to FIGS. 3 and 5, the electrical solenoid 28 is fastened to an L-shaped mounting bracket 41, and the bracket 41, in turn, is fastened to another bracket 42 which is secured to the plate 31. Grommets 43 and loose mechanical connections, as indicated at 44, are preferably provided to flexibly fasten the two brackets 41 and 42 together. The solenoid 28 includes an armature 46 which is movable vertically. When the solenoid 28 is energized, the armature 46 is forceably pulled downwardly, and when the solenoid 28 is not energized, a spring to be described returns the armature 46 to an upward position. The upward position is shown in FIGS. 3 and 6 of the drawings and the downward position where the solenoid is energized is shown in FIG. 7.

The described mounting of the solenoid is highly advantageous. The mounting 44 reduces vibrations and noise transmitted to the pipe 11. The vertical movement of the armature reduces wear on the solenoid parts, and the weight of the armature assists in moving it to the energized position, thereby permitting the use of a smaller size solenoid. It will be noted that a vertical side of the solenoid is fastened to the mounting brackets 41 and 42, and this mounting arrangement produces a smoother operation.

The two limit switches 24 and 25 are fastened along the upper edge of the plate 31, as shown in FIG. 3 by means of right angle mounting brackets 47, the brackets 47 also being shown in FIG. 1. The two stitches 24 and 25 respectively have actuating buttons 48 and 49, the contacts of the switches being normally open and being closed only when the buttons are moved upwardly, as seen in FIG. 3.

The mechanism 14 for pivoting the damper plate 10 to the open position and for actuating the switch 24 when the solenoid 28 is energized includes an L-shaped lever 51 that is pivotably mounted on a pin 52. The pin 52 is secured to the mounting plate 31 by a fastener 53 and is parallel to the pivot shaft 12, as best shown in FIG. 4. The lever 51 is formed from a flat sheet material and is secured to a hub 54. As best shown in FIGS. 4 and 5, the armature 46 is pivotably connected to the lever 51 by a pair of spaced parallel links 56, pins 57 at opposite ends of the links 56 pivotably connecting the links with the armature 46 and with the lever 51. It will be apparent, therefore, that when the armature 46 moves downwardly it will pivot the lever 51 in the counter-clockwise direction, as seen in FIG. 3, and a return movement of the lever 51 in the clockwise direction will cause the links 56 and the armature 46 to move upwardly.

A wire spring 61 has its lower end fastened to the mounting bracket 42 and its upper end engaging the lever 51 for urging the lever 51 in the clockwise direction, as seen in FIG. 3. The spring 61 is best seen in FIG. 1, and it will be noted that the lower end of the spring 61 is fastened to the bracket 42 by a clip 62. The upper end of the spring 61 engages a grooved roller 63 that is fastened to the lever 51, the upper end of the spring 61 extending into the groove of the roller 63. As previously mentioned, the spring 61 is shaped to impose a clockwise turning force on the lever 51, and consequently when the solenoid 28 is deenergized the spring 61 pivots the lever 51 in the clockwise direction and moves the armature 46 upwardly.

With reference to FIGS. 3 and 4, another lever 66 is pivotably mounted on the pin 52 and extends adjacent the longer arm of the L-shaped lever 51. As shown in FIG. 4, a screw 67 is fastened to the outer end of the lever 51, the screw 67 acting as a pin and extending underneath the lever 66. Because of the screw 67, when the lever 51 is pivoted in the clockwise direction, due to the action of the spring 61, the pin 67 engages the underside of the lever 66 and pivots the lever 66 in the clockwise direction as seen in FIG. 3.

As previously mentioned, the plate pivot shaft 12 has a hub 36 (FIGS. 3 and 4) fastened to its forward end, and a damper operating lever 71 is fastened to the hub 36 and to the shaft 12 so that these parts rotate together. The lever 71 is loosely connected to the outer end of the lever 66 as by a yoke and stud arrangement. In the present instance, a pair of flanges 72 forming a yoke on the outer end of the lever 66 encompass a stud 73 fastened to the lever 71. Due to this connection, when the lever 66 is pivoted in the counter-clockwise direction, as seen in FIG. 7, the yoke 72 moves the lever 71 in the counter-clockwise direction and pivots the shaft 12 and the plate 10 to the open position. When the lever 66 is subsequently pivoted in the clockwise direction, the yoke 72 causes the lever 71 to be pivoted in the clockwise direction.

At an angularly spaced position on the lever 71 is formed a finger 76. With specific reference to FIGS. 6 and 7, mounted below the limit switch 24 is an actuating member 78 that is pivotably mounted by a hinge pin 79 on the mounting bracket 47 for the switch 24. The actuating member 78 is located to engage the button 48 when the member 78 is pivoted in the clockwise direction on the pin 79. The free end of the member 78 has a downturned finger 82 formed on it which, as best shown in FIG. 7, is located to be engaged by the actuating finger 76 of the lever 71 when the lever 71 is pivoted in the counterclockwise direction. A short bracket 84 is fastened to the underside of the mounting bracket 47 and extends underneath the center section of the actuating member 78 in order to support the member 78 when the lever 71 is pivoted in the clockwise direction, as shown in FIG. 6.

As previously mentioned, both the lever 51 and the lever 66 are pivotably mounted on the pin 52. They are, however, interconnected by a resilient coupling which in the present example comprises a torsion spring 91 (FIGS. 1 and 4) which is wound and tensioned to produce a clockwise directed force on the lever 51 and a counter-clockwise directed force on the lever 66. One end of the torsion spring 91 is hooked on one of a plurality of fingers 92 (FIG. 6) formed on the lever 51 and the other end of the torsion spring is hooked on one of a plurality of similar fingers formed on the lever 66. While the torsion spring 91 produces relative tension between the two levers 51 and 66, the stop screw 67 holds the tension in the spring and the member 66 in engagement with the screw 67.

As previously mentioned, the lever 51 is fastened to the hub 54 and the hub 54 provides a bearing surface on a sleeve 96. Similarly, and with reference to FIGS. 1 and 4, the lever 66 is secured to a hub 94, and the torsion spring 91 is wound around the hub 94. The force of the torsion spring 91 on the two levers 51 and 66 tends to cock the two hubs 54 and 94 relative to the pin 52, and there is a danger that the hubs might bind on the pin. However, this is prevented by the sleeve 96 that is positioned on the pin 52 concentric with and between the pin 52 and the two hubs 54 and 94. Since the two hubs 54 and 94 and the steel sleeve 96 are all rotatable relative to each other and to the pin 52, even if one of the two hubs should cock, the associated lever will not bind on the pin since they will still rotate with the sleeve 96 on the pin.

The following is a description of the operation of the parts of the control mechanism 14 described thus far, assuming that all of the parts are in normal operating condition. If the thermostat 22 is open, indicating that the temperature around the thermostat is within the desired range, the valve 21 is deenergized and fuel is not fed into the combustion chamber. When the thermostat 22 closes, as previously described, the relay 27 closes and energizes the solenoid 28. When the solenoid is not energized, the armature 46 is in the upwardly displaced position shown in FIGS. 3 and 6. The spring 61 pivots the levers 51 and 66 in the clockwise direction, as seen in FIG. 3, on the pin 52. Further, the screw 67 engages the lever 66, and the lever 66 holds the lever 71 in the clockwise pivoted position. The lever 71 is displaced from the lever or actuating member 78 and, as shown in FIG. 6, the weight of the member 78 holds the member downwardly and away from the actuating button 48 of the switch 24.

When the thermostat 22 closes and the solenoid 28 is energized, the armature 46 is quickly moved downwardly to the position fully seated on the coil body, as shown in FIG. 7. The links 56 and the lever 51 follow the rapid movement of the armature 46 and the screw 67 is displaced downwardly from the lever 66. The torsional force exerted by the resilient coupling spring 91 then turns the lever 66 in the counterclockwise direction and the yoke and stud connection turns the lever 71 in the counter-clockwise direction. This action opens the damper plate 10. The lever 71 swings to the position shown in FIG. 7 where the finger 76 engages the downturned end 82 of the actuating member 78, thereby swinging the member 78 in the clockwise direction, which action pushes the button 48 upwardly and actuates the switch 24. As soon as the switch 24 is closed, the thermostat 22 having previously been closed, the valve 21 is energized and fuel is fed into the combustion chamber.

Subsequently, when the thermostat 22 opens, the solenoid 28 ceases to be energized. The spring 61, which constantly urges the lever 51 in the clockwise direction, then swings the lever 51 from the position shown in FIG. 7 toward the position shown in FIG. 6. The screw 67, which is in engagement with the underside of the lever 66, swings the lever 66 in the clockwise direction and the yoke 72 swings the lever 71 in the clockwise direction. This moves the lever 71 away from the downturned end 82 of the actuating member 78 and the switch 24 is then opened. The fuel valve 21 was, however, previously deenergized when the thermostat 22 opened. Thus, the spring 61 swings the levers 51, 66, and 71 in the clockwise direction which moves the damper plate 10 from the open position toward the closed position.

Figure 8:
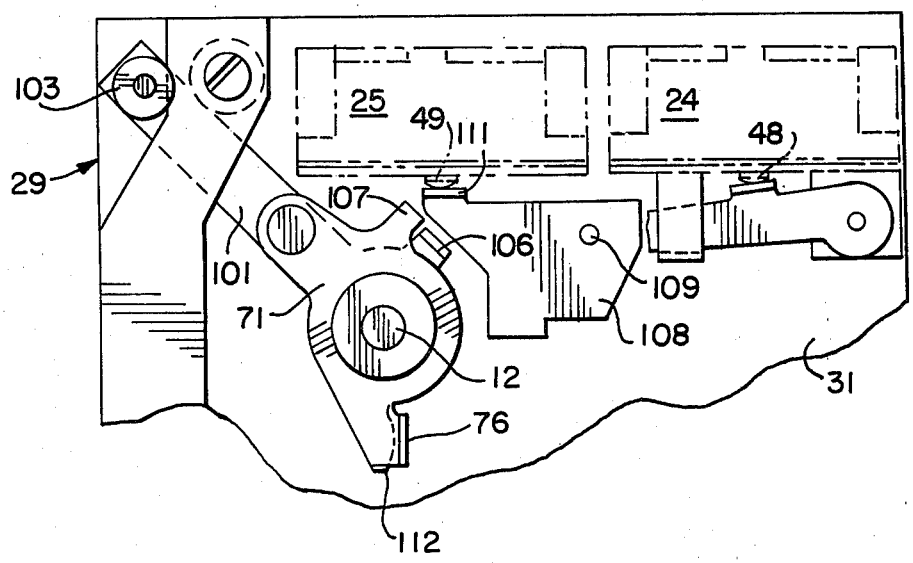
FIGS. 8 and 9 are fragmentary views illustrating the operation of a manual override mechanism.
Figure 9:
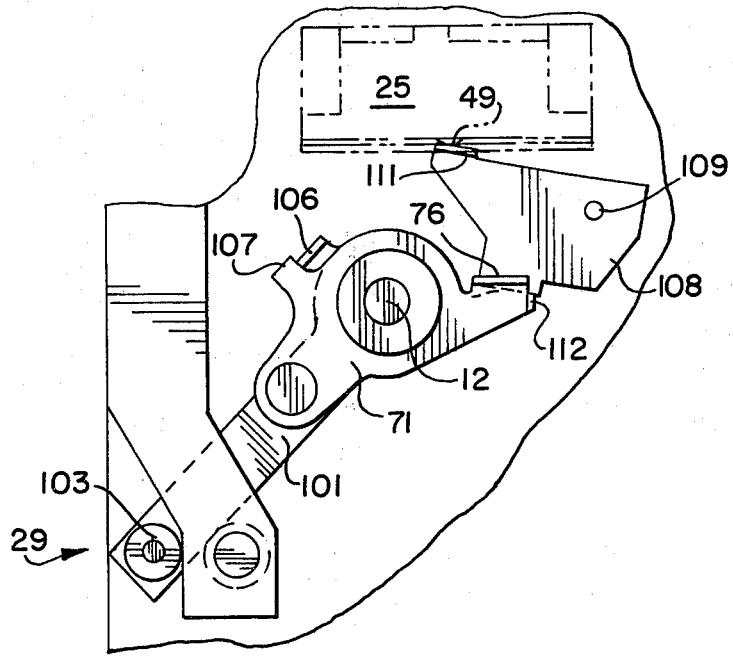

The apparatus further includes a manual override to open the damper plate 10 and effect completion of the electrical circuit to the valve 21 in the event of failure of either the relay 27, the solenoid 28 or the limit switch 24 by completing the electrical circuit through the limit switch 25. The construction and operation of the manual override are shown particularly in FIGS. 8 and 9, wherein the override comprises an override lever 101 that has one end thereof pivotally mounted on the plate pivot shaft 12 adjacent the lever 71. As shown in FIGS. 8 and 9, the lever 101 extends radially outwardly from the shaft 12, and it is manually movable between a normal position shown in FIG. 8 and an override position shown in FIG. 9. Two holes 102 (shown in FIGS. 3 and 4) are formed in the mounting plate 31 for use in locking the override lever 101 in either of its two positions. A manually operable pin 103 is positioned through a hole formed in the lever 101 and one of the holes 102 for holding the lever in a selected position.

With reference to FIGS. 8 and 9, the lever 101 includes a finger or tab 106 which extends radially outwardly relative to the shaft 12, the tab 106 extending adjacent a finger or tab 107 formed on the lever 71. When the lever 101 is in the normal position shown in FIG. 8, the tab 106 is displaced slightly from the clockwise side of the tab 107. The shaft 12 and the lever 71 are, therefore, free to rotate in the counter-clockwise direction when the damper plate is opened during automatic operation as previously described. However, when the pin 103 is removed from the upper hole 102 formed in the plate 31 and the lever 101 is pivoted in the counter-clockwise direction, the tab 106 engages the finger 107 and the two levers 71 and 101 swing in the counter-clockwise direction to the override position shown in FIG. 9. Turning movement of the lever 71, of course, turns the shaft 12 and moves the damper plate 10 to the open position. The finger 76 of the lever 71 engages the actuating member 78 and effects closure of the switch 24, as explained in connection with FIGS. 6 and 7. In addition, the limit switch 25, which is connected in parallel with the switch 24, is also closed due to engagement of the lever 101 with another actuating member 108. The member 108 is formed from a relatively flat plate which is pivotally mounted on the mounting plate 31 by a pin 109 and is mounted generally below the switch 25. The member 108 includes a finger 111, located below the button 49 of the switch 25, and when the member 108 is pivoted in the clockwise direction, as seen in FIGS. 8 and 9, the finger 111 engages the button 49 and actuates the switch 25. It will be noted from FIGS. 8 and 9 that when the override lever 101 is pivoted to the override position shown in FIG. 9, another finger 112 formed on the lever 101 engages the underside of the member 108 and pivots it a short distance in the clockwise direction in order to press the button 49 upwardly and actuate the switch 25. As long as the lever 101 is held in the override position, the switch 25 will, therefore, be closed. When the lever 101 is subsequently turned or pivoted in the clockwise direction and returned to the normal position shown in FIG. 8, the finger 112 moves out of engagement with the member 108 and gravity returns the member 108 to the position shown in FIG. 8 where the switch 25 is not energized. The action of the lever 101 pivoting in the clockwise direction moves the tab 106 away from the finger 107, and the force of the spring 61 pivots the levers 51, 66, and 71 to the position where the damper plate is closed as previously described. During the operation of the manual override mechanism, the levers 66 and 51 are also pivoted due to their corresponding with the lever 71. Thus, the return spring 61 operates to close the damper plate 10 both during automatic operation and during manual override operation.

It will be apparent from the foregoing description and the drawings that the invention includes numerous advantages. Even though the automatic operation mechanism includes a solenoid, which is considered more reliable and less expensive than a motor, the apparatus does not produce a great deal of noise during operation. Even though the solenoid may operate with a rapid action, the armature of the solenoid is connected by means of a resilient coupling to the levers operating the limit switch and the damper plate. The limit switch 24 is not closed until the damper plate is completely opened, this being accomplished by connecting the plate operating mechanism to actuate the switch. The arrangement of the manual override is advantageous since there is a positive mechanical connection between the override lever and the damper plate and due to the fact that both switches 24 and 25 are actuated when the manual override lever is operated. Consequently, even though the frequently operated switch 24 may have failed, the other switch 25, which is connected in parallel with the switch 24, will provide an electrical connection to the fuel control valve. In both the automatic operation and the manual override operation, a flexible wire spring returns the damper plate to its normally closed position.

I claim:

1. An automatic control for a flue damper including a damper plate mounted in a flue pipe and pivotally movable between an open position and a closed position, said control comprising in combination:

a solenoid mounted for substantially vertical movement of an armature between an energized position and a deenergized position;

a lever mechanism operatively connecting said armature to the damper plate for moving said damper plate to its open position when said solenoid is energized; and return spring means cooperating with the damper plate for returning the damper plate to its closed position when said solenoid is deenergized;

said lever mechanism including a mounting pin parallel to the pivot axis of the damper plate, first lever means operatively connected to said armature and pivotally mounted on said pin, and second lever means operatively connected to the damper plate and pivotally mounted on said pin adjacent said first lever means;

resilient coupling means comprising a torsion spring tensioned around said mounting pin and engaged at its ends with said first and second lever means for pivotally urging said first lever means in one direction and said second lever means in the opposite direction; and stop means projecting from one of said lever means and engaging the other of said lever means for maintaining pre-set tension in said torsion spring;

movement of said armature to its energized position effecting rapid pivotal movement of said first lever means, and said torsion spring effecting resilient pivotal movement of said second lever means and thereby moving the damper plate to open position.

2. An automatic control as in claim 1, wherein said solenoid is mounted so that said armature is moved downwardly to said energized position when said solenoid is energized, and said armature is moved upwardly to said deenergized position by the action of said return spring means when said solenoid is deenergized.

3. An automatic control as in claim 1, and further including a switch adapted to control operation of a fuel control valve, and said second lever means effecting actuation of said switch in addition to opening said damper plate.

4. An automatic control as in claim 1, and further including manually operable override lever means pivotally movable from a normal position to an override position, said override lever means effecting movement of said second lever means during movement to said override position and thereby opening said damper plate.

5. An automatic control as in claim 4, and further including first and second switch means electrically connected in parallel and adapted to control operation of a fuel control valve, said second lever means effecting actuation of said first switch means, and said override lever means effecting actuation of said second switch means upon movement of said override lever means to said override position, whereby to effect operation of the fuel control valve even if said first switch means has failed.

6. An automatic control as in claim 2, wherein said return spring means coacts with said first lever means for urging said armature upwardly and closing said damper plate when said solenoid is deenergized.

7. An automatic control as in claim 1, wherein said first lever means is operatively connected to said armature by link means pivotally connected with said armature and with said first lever means.

8. An automatic control as in claim 1, and further including a pivot shaft for said damper plate, a damper operating lever rigidly connected to said pivot shaft, and means loosely connecting said second lever means with said damper operating lever for opening said damper plate.

9. An automatic control as in claim 8, and further including a manually operable override lever pivotally mounted on said pivot shaft adjacent said damper operating lever, said override lever being movable from a normal position to an override position, and said override lever and said damper operating lever having interengaging portions, whereby movement of said override lever to said override position effects movement of said damper operating lever to open said damper plate.

10. An automatic control as in claim 9, and further including first and second switch means electrically connected in parallel and adapted to control operation of a fuel control valve, said damper operating lever having an actuating portion for actuating said first switch means when said solenoid is energized, and said override lever having an actuating portion for actuating said second switch means upon movement of said override lever to said override position, whereby to effect operation of the fuel control valve even if said first switch means has failed.

11. An automatic control as in claim 1, and further including a concentric sleeve rotatable on said mounting pin, and said first and second lever means having hub portions providing bearing surfaces rotatably supporting said lever means on said sleeve, whereby to avoid binding of said lever means due to the tendency of said hub portions to cock under the force of said torsion spring.

* * * * *